US009825432B2

(12) United States Patent
Deguchi et al.

(10) Patent No.: US 9,825,432 B2
(45) **Date of Patent: *Nov. 21, 2017**

(54) SPARK PLUG FOR INTERNAL COMBUSTION ENGINE AND PRODUCTION METHOD THEREOF

(71) Applicant: DENSO CORPORATION, Kariya, Aichi-pref. (JP)

(72) Inventors: Masataka Deguchi, Kariya (JP); Kanechiyo Terada, Kariya (JP); Tetsuya Miwa, Kariya (JP); Yuuki Tsukamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/261,017

(22) Filed: Sep. 9, 2016

(65) Prior Publication Data

US 2017/0077682 A1 Mar. 16, 2017

(30) Foreign Application Priority Data

Sep. 11, 2015 (JP) ..... 2015-179705

(51) Int. Cl.

| | |
|---|---|
| ***H01T 13/32*** | (2006.01) |
| ***H01T 13/38*** | (2006.01) |
| ***H01T 13/39*** | (2006.01) |
| ***H01T 21/02*** | (2006.01) |

(52) U.S. Cl.

CPC ..... *H01T 13/32* (2013.01); *H01T 13/38* (2013.01); *H01T 13/39* (2013.01); *H01T 21/02* (2013.01)

(58) Field of Classification Search

CPC ..... H01T 13/32; H01T 21/02; H01T 13/39; H01T 13/38

See application file for complete search history.

(56) References Cited

U.S. PATENT DOCUMENTS

| | | | | |
|---|---|---|---|---|
| 2,586,864 | A | 2/1952 | Rose | |
| 2007/0069618 | A1 | 3/2007 | Havard et al. | |
| 2015/0145402 | A1 * | 5/2015 | Hasegawa | H01T 13/32 313/140 |
| 2016/0064903 | A1 | 3/2016 | Deguchi et al. | |
| 2017/0077679 | A1 * | 3/2017 | Deguchi | H01T 13/16 |

* cited by examiner

*Primary Examiner* — Donald Raleigh
*Assistant Examiner* — Kevin Quarterman
(74) *Attorney, Agent, or Firm* — Nixon & Vanderhye P.C.

(57) ABSTRACT

A spark plug for an internal combustion engine is provided which includes a housing, a porcelain insulator, a center electrode, and an annular ground electrode. The housing has a small-diameter portion which has a smaller inner diameter and defines a front end thereof. The ground electrode is secured to a front end surface of the small-diameter portion and forms a spark gap between itself and an outer periphery of the center electrode. The ground electrode is smaller in outer diameter than the front end surface of the small-diameter portion. A annular weld which joints the ground electrode and the small-diameter portion is formed in an annular boundary through which the front end surface of the small-diameter portion and the base end surface of the ground electrode face each other. The annular weld continuously and fully extends in a circumferential direction of the ground electrode.

5 Claims, 12 Drawing Sheets

SPARK PLUG FOR INTERNAL COMBUSTION ENGINE AND PRODUCTION METHOD THEREOF

CROSS REFERENCE TO RELATED DOCUMENT

The present application claims the benefit of priority of Japanese Patent Application No. 2015-179705 filed on Sep. 11, 2015, the disclosure of which is incorporated herein by reference.

BACKGROUND

1. Technical Field

This disclosure relates generally to a spark plug for internal combustion engines which has an annular ground electrode disposed to face an outer circumference of a center electrode, and a production method thereof.

2. Background Art

For instance, Japanese Patent No. 5075127 discloses a spark plug for use in internal combustion engines mounted in automotive vehicles or cogeneration systems. The spark plug has an annular ground electrode which faces an outer periphery of a center electrode. The joint of the ground electrode to a housing of the spark plug is achieved by crimping a front end of the housing inwardly to define a spark gap between the outer circumference of the center electrode and the inner circumference of the annular ground electrode.

The above spark plug, as described above, has the structure in which the ground electrode is tightly held inside the crimped front end of the housing to make a mechanical contact of the outer periphery of the ground electrode with the housing, thus resulting in an increased length of a heat dissipating path between the inner peripheral surface of the ground electrode which faces the spark gap and the housing. This increases the risk of higher temperatures occurring in the ground electrode, which usually leads to an increase in mechanical wear of portions of the electrodes around the spark gap, thereby accelerating the rate at which the size of the spark gap increases, thereby shortening the time taken to reach an upper limit of a size of the spark gap. It is, thus, difficult to produce spark plugs which have an increased service life.

The ground electrode is disposed inside the housing. The spark gap has an end located inside the front end of the housing in the lengthwise direction of the spark plug, thus encountering a probability that it is difficult for flame, as created by a spark generated in the spark gap, to grow, that is, a cooling loss increases in the spark plug, which will result in a reduced ability to ignite fuel in the engine.

The above spark plug, as described above, has the ground electrode tightly pressed inside the housing. It is, thus, difficulty to adjust the position of the ground electrode, that is, the size of the spark gap. Specifically, the accurate creation of the spark gap between the outer periphery of the center electrode and the inner periphery of the ground electrode requires increased accuracy in positioning the ground electrode relative to the center electrode. A variation in dimension or an assembling error of parts such as the housing etc. results in a failure in forming a desired spark gap even if the ground electrode is accurately positioned relative to the housing, thus requiring the need to position the ground electrode relative to the center electrode. However, in the structure in which the ground electrode is disposed radially inside the crimped front end of the housing, a great variation in dimension or a great assembling error of parts of the spark plug will restrict movement of the ground electrode in a radial direction of the spark plug. It is, thus, difficult to accurately adjust the size of the spark gap.

SUMMARY

It is therefore an object to provide a spark plug for an internal combustion engine which is designed to have an increased service life, an enhanced ability to ignite fuel, and a spark gap which is easy to adjust.

It is another object of the invention to provide a production method of the above type of a spark plug.

According to one aspect of the invention, there is provided a spark plug for an internal combustion engine which comprises: (a) a cylindrical housing; (b) a cylindrical porcelain insulator which is retained inside the housing; (c) a center electrode which is retained inside the porcelain insulator and has a head extending outside a front end of the porcelain insulator; and (d) an annular ground electrode which is secured to a front end of the housing. The housing has a small-diameter portion formed on the front end thereof. The small-diameter portion has an inner diameter which is smaller than that of a rest of the housing. The ground electrode protrudes from a front end surface of the small-diameter portion and has an inner peripheral surface facing an outer peripheral surface of the center electrode. The ground electrode has an outer diameter which is smaller than an outer diameter of the front end surface of the small-diameter portion. An annular boundary is provided through which the front end surface of the small-diameter portion and a base end surface of the ground electrode face each other. The annular boundary has an annular region which occupies a portion of a width thereof and fully extends in a circumferential direction thereof and in which an annular weld is formed which establishes a joint between the housing and the ground electrode. The annular weld continuously extends in a circumferential direction of the annular region.

According to another aspect of the invention, there is provided a production method of a spark plug for an internal combustion engine. The spark plug comprises: (a) a cylindrical housing; (b) a cylindrical porcelain insulator which is retained inside the housing; (c) a center electrode which is retained inside the porcelain insulator and has a head extending outside a front end of the porcelain insulator; and (d) an annular ground electrode which is secured to a front end of the housing. The housing has a small-diameter portion formed on the front end thereof. The small-diameter portion has an inner diameter which is smaller than that of a rest of the housing. The ground electrode protrudes from a front end surface of the small-diameter portion and has an inner peripheral surface facing an outer peripheral surface of the center electrode. The ground electrode has an outer diameter which is smaller than an outer diameter of the front end surface of the small-diameter portion. The production method comprises: (a) preparing the housing having an annular protrusion which is formed on the front end surface of the small-diameter portion and continuously and fully extends in a circumferential direction of the small-diameter portion or the ground electrode having an annular protrusion which is formed on a base end surface of the ground electrode and continuously and fully extends in a circumferential direction of the base end surface, the annular protrusion having a width in a radial direction of the spark plug, the width being smaller than a width of an annular boundary in the radial direction of the plug, the annular boundary being a boundary through which the front end surface of the small-diameter portion and the base end surface of the ground electrode face each other; (b) an assembling step of preparing an assembly of the porcelain insulator and the center electrode and then install the assembly inside the housing so as to have the center electrode inserted into an inner periphery of the small-diameter portion; and (c) a joining step which is performed following the assembling step. The joining step places the annular protrusion in contact with the base end surface of the ground electrode or the front end surface of the small-diameter portion and then performs resistance welding to join the ground electrode to the small-diameter portion.

In the spark plug as described above, the outer diameter of the ground electrode is smaller than that of the front end surface of the small-diameter portion of the housing. The ground electrode is welded to the front end surface of the small-diameter portion of the housing. The ground electrode and the housing, therefore, face each other in contact with each other in an axial direction of the spark plug. Specifically, the ground electrode and the housing continuously and fully contact each other in the circumferential direction of the spark plug, thereby ensuring a large area of contact and shortening a heat dissipating path between the inner peripheral surface of the ground electrode facing the spark gap and the housing. This enhances the release of heat from the ground electrode which is exposed to combustion of fuel in the engine and heated to high temperature to the housing mounted in an engine head, thus minimizing a rise in temperature of the ground electrode, thereby reducing mechanical wear of the inner peripheral surface of the ground electrode, which retards an increase in size of the spark gap to obtain a desired service life of the spark plug.

The ground electrode projects from the front end surface of the housing, so that the spark gap is located outside the front end of the housing in the axial direction of the spark plug, thereby avoiding contact of the flame, as created by a spark generated in the spark gap, with the housing, which usually causes the heat of the flame to be drawn into the housing, thus resulting in a failure in growing the flame. In other words, the cooling loss of thermal energy required to grow the flame is minimized to improve the ability of the spark plug to ignite the fuel.

The spark plug is designed to have the ground electrode which faces the outer peripheral surface of the center electrode and is welded to the front end surface of the small-diameter portion of the housing, thus facilitating the ease with which the ground electrode is positioned to the center electrode when they are welded together. Specifically, when the ground electrode is welded to the housing, it is possible to move the ground electrode along the front end surface of the small-diameter portion of the housing to fix a desired location of the ground electrode relative to the center electrode regardless of a variation in dimension of the parts of the spark plug, which facilitates the ease of adjustment of the spark gap between the center electrode and the ground electrode.

The annular weld continuously and fully extends over the annular region which occupies a portion of the width of the annular boundary through which the front end surface of the small-diameter portion and the base end surface of the ground electrode face each other. In other words, the annular protrusion which is of a complete ring shape and used to make a weld between the small-diameter portion and the ground electrode is formed to fully extend in the circumferential direction of the ground electrode or the housing. The annular protrusion has a smaller width than that of the ground electrode or the small-diameter portion, thus equalizing distribution of electrical current over the entire circumference of the annular protrusion in the annular region during the resistance welding, thereby ensuring the stability in welding the ground electrode to the small-diameter portion, that is, in positioning the ground electrode relative to the center electrode to achieve a desired size of the spark gap.

In the production method of the spark plug, the joining step is executed after the assembling step. This enables the spark gap between the ground electrode and the center electrode to be adjusted in the joining step. It is, thus, possible to complete the adjustment of the spark gap at a time when the ground electrode is welded to the small-diameter portion of the housing, thereby enhancing the accuracy in adjusting the spark gap and also facilitating the ease of such adjustment.

The joining step is to place the annular protrusion in contact with the base end surface of the ground electrode or the front end surface of the small-diameter portion and then resistance-weld the ground electrode to the small-diameter portion. The resistance-welding is, therefore, made only at a circumferentially extending portion of the width of the annular boundary, not the whole of the annular boundary where the small-diameter portion and the ground electrode face each other, thereby facilitating ease with which the entire circumference of the ground electrode is continuously welded to the small-diameter portion to ensure the stability in joining the ground electrode to the small-diameter portion, that is, in positioning the center electrode and the ground electrode relative to each other to obtain a desired size of the spark gap.

This disclosure, therefore, provides the spark plug and the production method of the spark plug which has an increased service life, an enhanced ability to ignite fuel, and a spark gap easy to adjust.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENT

First Embodiment

Figure 1:
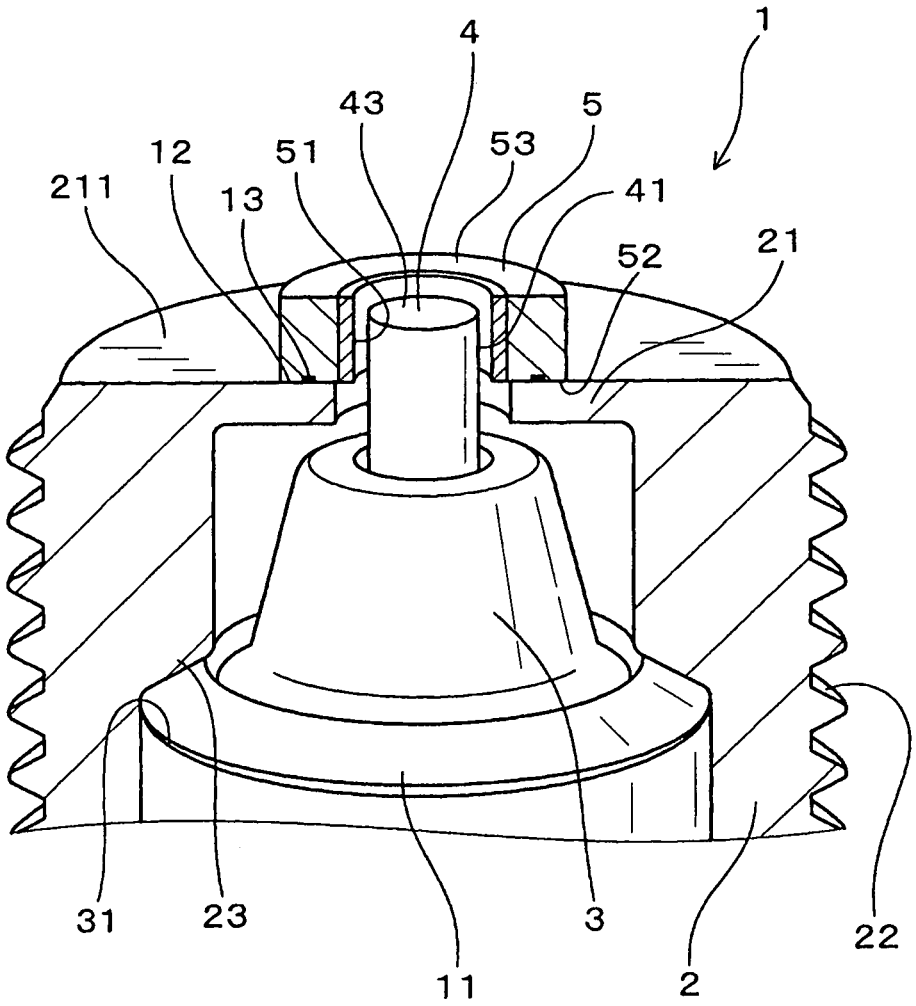
FIG. 1 is a partially perspective sectional view which illustrates a region around a front end portion of a spark plug according to the first embodiment.

The spark plug 1 for use with an internal combustion engine and a production method thereof will be described below with reference to FIGS. 1 to 13.

The spark plug 1 of the first embodiment, as illustrated in FIGS. 1 to 4, includes a hollow cylindrical housing 2 (also called a shell), a cylindrical porcelain insulator 3 retained inside the housing 2, a center electrode 4, and an annular ground electrode 5. The center electrode 4 is retained inside the porcelain insulator 3 and partially projects from a front end (i.e., a head) of the porcelain insulator 3. The annular ground electrode 5 is secured to the front end of the housing 2.

The housing 2 has a small-diameter portion 21 formed on a front end (i.e., a head) of the housing 2. The small-diameter portion 21 has an inner diameter D4 which is smaller than that of the rest of the housing 2.

The ground electrode 5 is placed on a front end surface 211 of the small-diameter portion 21. The ground electrode 5 has an inner peripheral surface 51 facing an outer peripheral surface 41 of the center electrode 4. The ground electrode 5 preferably has a front end surface 53 located outside a front end surface 43 of the center electrode 4 in an axial direction of the spark plug 1. The ground electrode 5 has an outer diameter D1 which is smaller than an outer diameter D0 of a front end surface 211 of the small-diameter portion 21.

Figure 4:
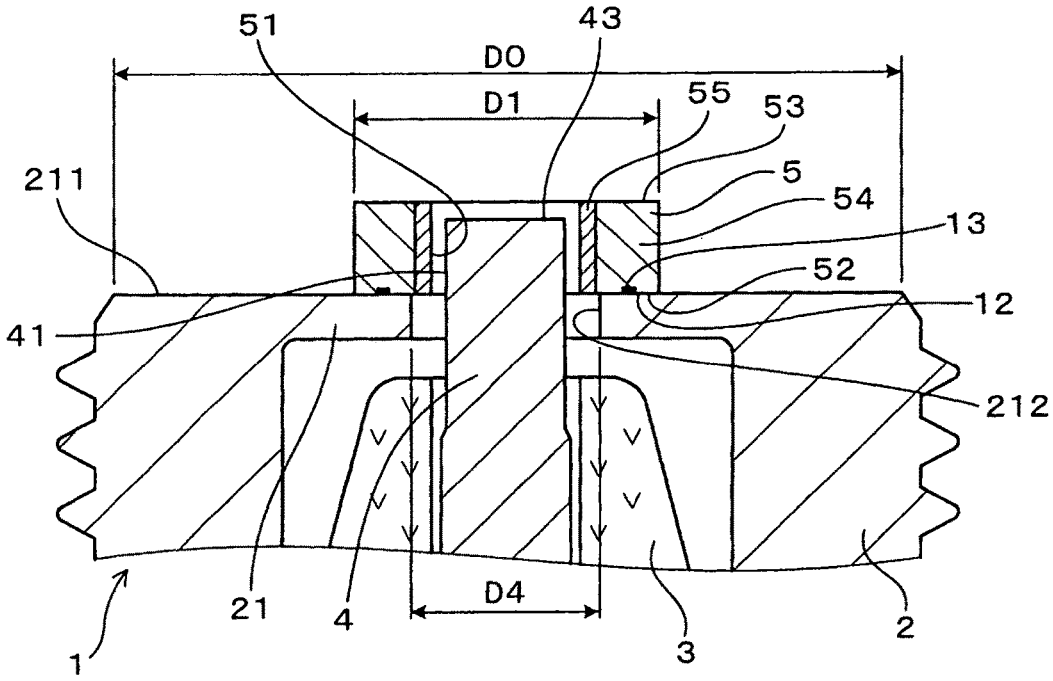
FIG. 4 is a partial section view which illustrates a region around a top end portion of a spark plug of the first embodiment.
Figure 5:
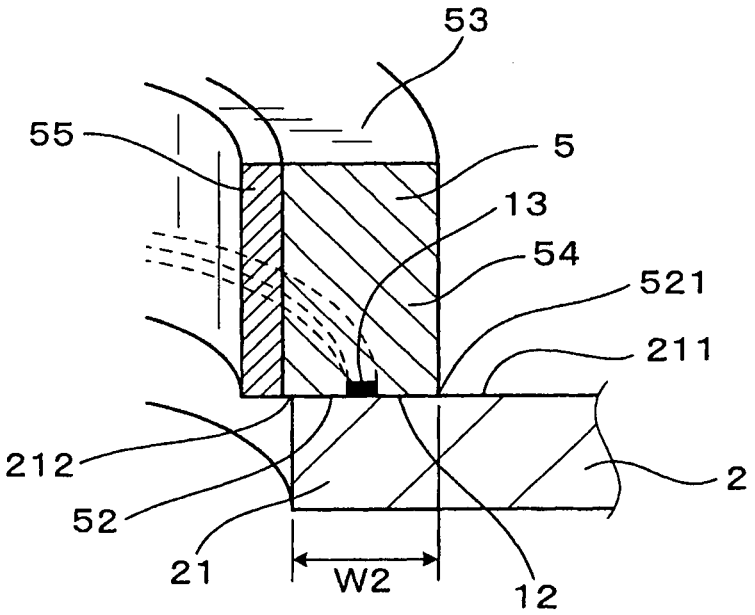
FIG. 5 is a partially perspective sectional view which illustrates a region around a ground electrode welded to a housing of a spark plug of the first embodiment.
Figure 6:
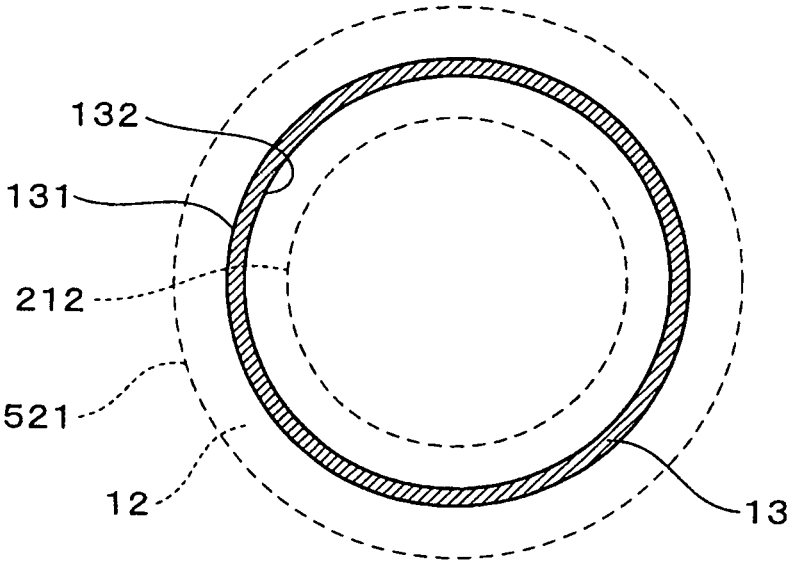
FIG. 6 is an explanatory view which represents a positional relation between an annular boundary and an annular weld of a spark plug of the first embodiment.

The front end surface 211 of the small-diameter portion 21, as illustrated in FIGS. 4 to 6, faces a base end surface 52 of the ground electrode 5 through an annular boundary 12. The annular boundary 12 has an annular region which occupies a portion of a width thereof and fully extends in a circumferential direction thereof and in which an annular weld 13 is formed which establishes a mechanical joint between the housing 2 and the ground electrode 5. The annular weld 13 continuously extends in the circumferential direction of the annular boundary 12.

The spark plug 1 is used as an igniter in internal combustion engines mounted in, for example, automotive vehicles or cogeneration systems. In the following discussion, when the spark plug 1 is installed in the internal combustion engine, a portion of the spark plug 1 exposed to a combustion chamber of the internal combustion engine will also be referred to as a front end or a front end side, while a portion of the spark plug 1 furthest away from the front end will also be referred to as a base end or a base end side. A plug axial direction, a plug radial direction, and a plug circumferential direction, as referred to herein, are a lengthwise direction, a radial direction, and a circumferential direction of the spark plug 1, respectively.

Figure 3:
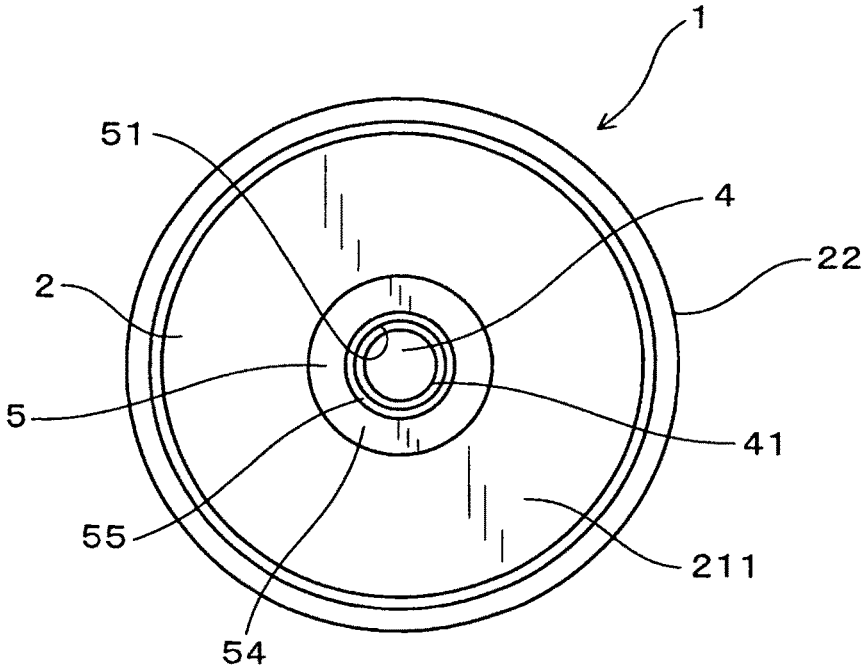
FIG. 3 is a plane view which illustrates a spark plug, as viewed from a top end thereof.

The center electrode 4 of this embodiment is, as can be seen in FIGS. 1 and 3, of substantially a cylindrical shape and arranged coaxially with the cylindrical housing 2, the cylindrical porcelain insulator 3, and the cylindrical ground electrode 5. The annular weld 13 is, as can be seen in FIGS. 5 and 6, shaped to extend coaxially with the ground electrode 5, in other words, have the same center as that of the ground electrode 5.

The annular weld 13, as described above in FIGS. 4 to 6, lies on the annular region of the annular boundary 12 through which the base end surface 52 of the ground electrode 5 faces the front end surface 211 of the small-diameter portion 21 of the housing 2. The annular weld 13 has an inner circumferential edge 132 located outside the inner circumferential edge 212 of the front end surface 211 of the small-diameter portion 21. The annular weld 13 has an outer circumferential edge 131 located inside the outer circumferential edge 521 of the base end surface 52 of the ground electrode 5.

The annular weld 13 is shaped to extend from the front end surface 211 of the small-diameter portion 21 into the ground electrode 5. Specifically, the annular weld 13 is embedded deeply from the base end surface 52 of the ground electrode 5.

Figure 7:
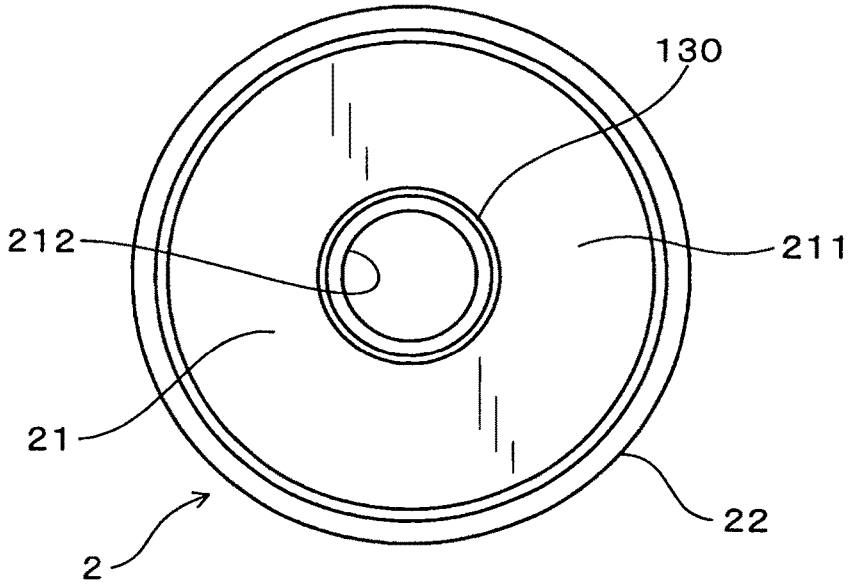
FIG. 7 is a plane view which illustrates a front end surface of a housing before a ground electrode is welded to the housing in a spark plug of the first embodiment.
Figure 8:
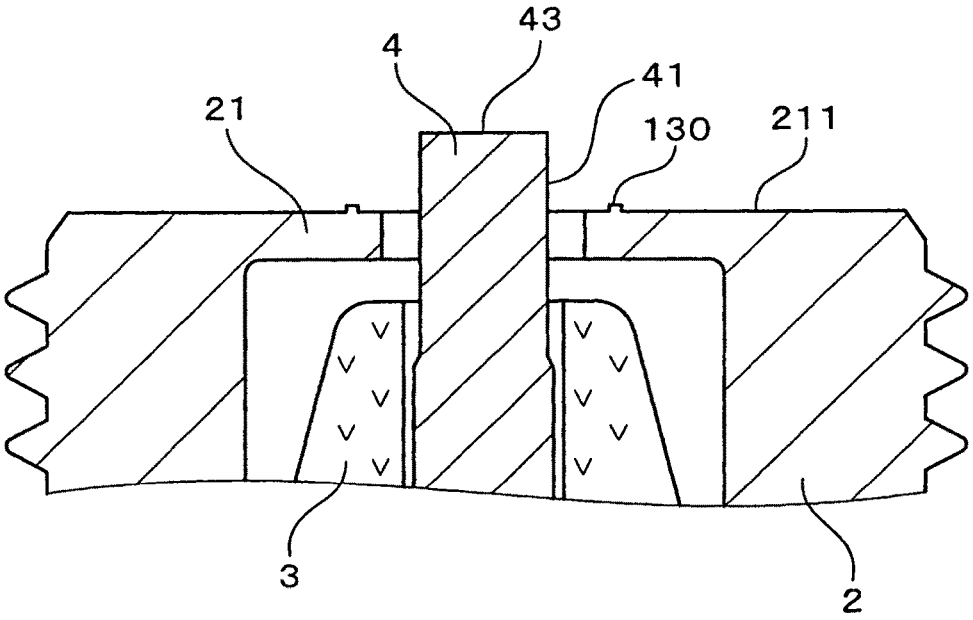
FIG. 8 is a partial section view which illustrates a region around a front end portion of a spark plug before a ground electrode is welded to a housing in the first embodiment.

The front end surface 211 of the housing 2, as illustrated in FIGS. 7 and 8, has an annular protrusion 130 formed thereon. The front end surface 211 is flat except the annular protrusion 130 and extends perpendicular to the plug axial direction. In the following discussion, the front end surface 211 of the small-diameter portion 21 of the housing 2 represents a front end surface (i.e., an uppermost surface in FIG. 8) of the housing 2 in the plug axial direction except for the annular protrusion 130. The ground electrode 5, as can be seen in FIG. 10(B), has the base end surface 52 and the front end surface 53 which are opposed to each other through a thickness thereof and both flat. The base end surface 52 of the ground electrode 5 and the front end surface 211 of the small-diameter portion 21 of the housing 2 are placed in face-to-face contact with each other and welded together.

Figure 2:
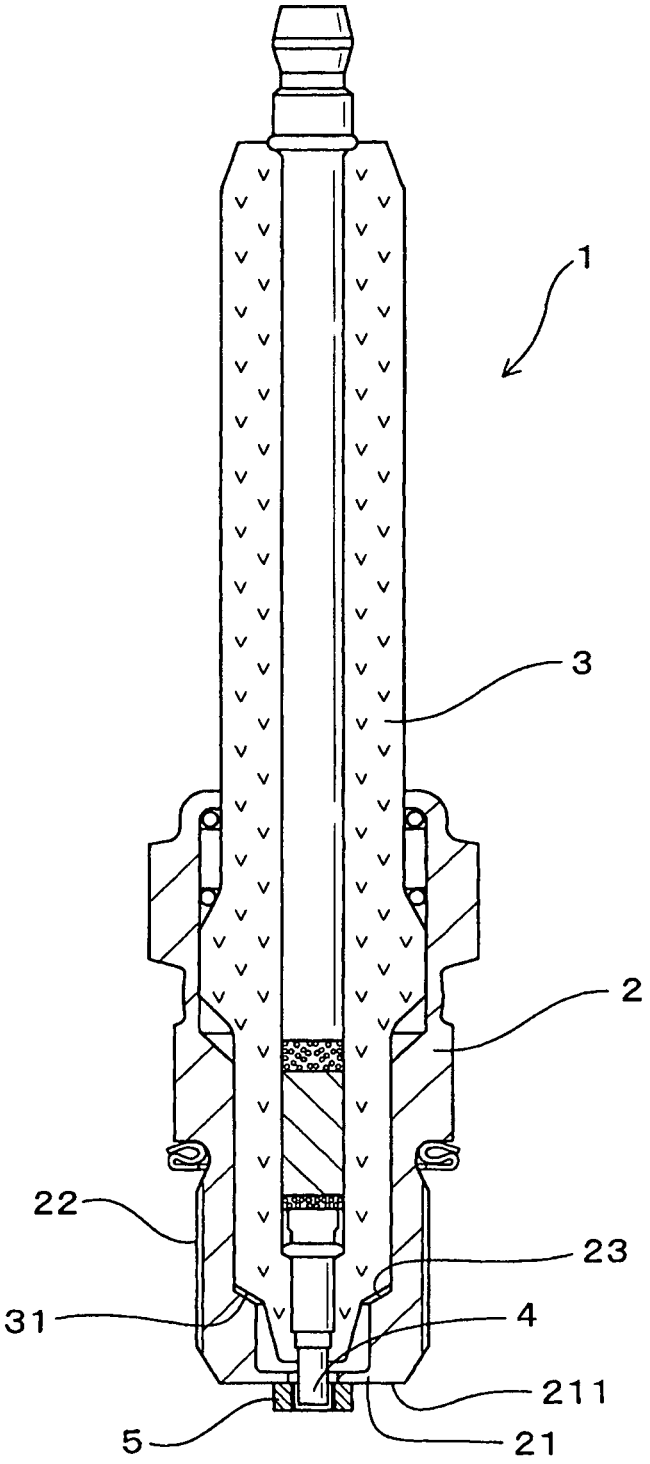
FIG. 2 is a longitudinal sectional view which illustrates a spark plug according to the first embodiment.

The housing 2, as illustrated in FIGS. 1 and 2, has an attachment screw 22 for mounting the spark plug 1 in the internal combustion engine and is made of, for example, Fe-based alloy.

The porcelain insulator 3 has an outer shoulder 31 formed on an outer periphery thereof. The housing 2 has an inner shoulder formed on an inner periphery thereof. The porcelain insulator 3 is retained in the housing 2 with the outer shoulder 31 seated on the inner shoulder 23 of the housing 2 in the plug axial direction. An annular gasket (also called packing) 11 is interposed between the outer shoulder 31 of the porcelain insulator 3 and the inner shoulder 23 of the housing 2.

Figure 10A:
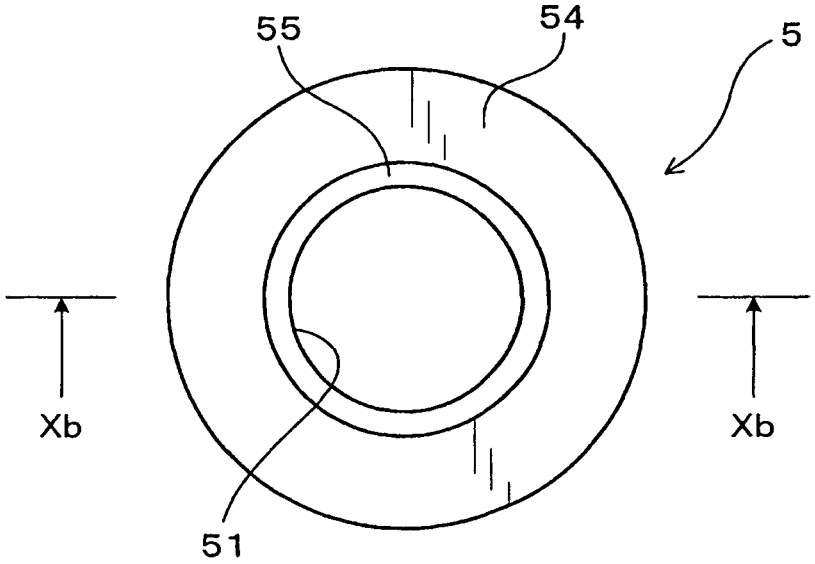
FIG. 10(A) is a plane view of a ground electrode of a spark plug in the first embodiment.
Figure 10B:
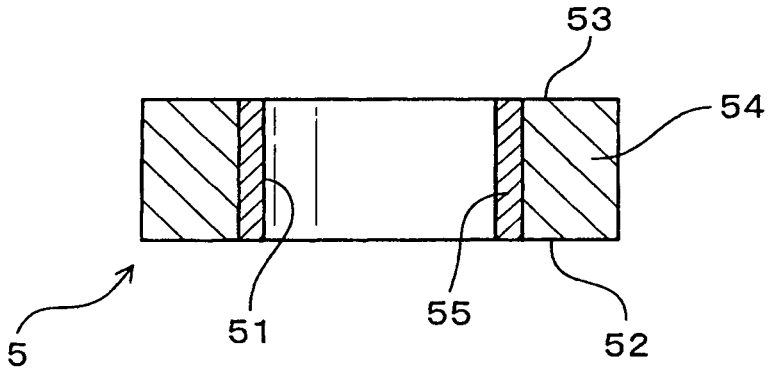
FIG. 10(B) is a sectional view, as taken along the line Xb-Xb of FIG. 10(A)

The ground electrode 5, as illustrated in FIGS. 10(A) and 10(B), includes an annular main electrode body 54 and a noble metal layer 55 formed on an inner peripheral surface of the main electrode body 54. The main electrode body 54 is made of, for example, Ni-based alloy. The noble metal layer 55 is made of, for example, platinum (Pt) or Iridium (Ir) or alloy thereof. The noble metal layer 55 is diffusion-bonded to the main electrode body 54. The noble metal layer 55 has a thickness of, for example, 0.1 mm to 0.5 mm. The ground electrode 5 is, as described above, made up of two parts: the main electrode body 54 and the noble metal layer 55 in order to enhance the wear-resistance of the ground electrode 5 to increase the service life of the spark plug 1.

Figure 9:
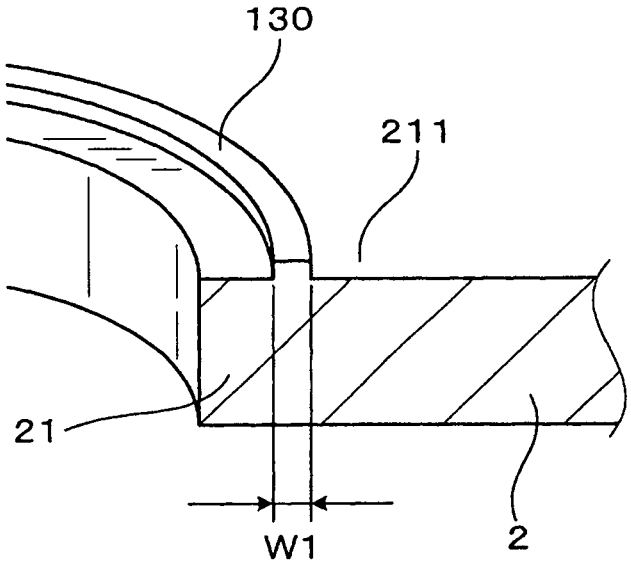
FIG. 9 is a partially perspective sectional view which illustrates a small-diameter portion of a housing before a ground electrode is welded to the housing in a spark plug of the first embodiment.

The joining of the ground electrode 5 to the front end surface 211 of the small-diameter portion 21 is achieved by resistance welding. Before the ground electrode 5 is welded to the front end surface 211, the annular protrusion 130, as clearly illustrated in FIGS. 7 to 9, lies on the front end surface 211 of the small-diameter portion 21 of the housing 2 and continuously extends in a complete circle in the circumferential direction of the small-diameter portion 21. The annular protrusion 130, as illustrated in FIG. 9, has a width W1 in the plug radial direction which is, as illustrated in FIG. 5, smaller than the width W2 of the annular boundary 12 in the plug radial direction.

The spark plug 1 is produced in a sequence of assembling steps and a joining step, as described below.

The assembling steps are, as illustrated in FIG. 8, steps to prepare an assembly of the porcelain insulator 3 and the center electrode 4 and then install the assembly inside the housing 2 so as to have the center electrode 4 inserted into the inner periphery of the small-diameter portion 21. The joining step is, as illustrated in FIGS. 11 and 4, a step to connect the ground electrode 5 to the small-diameter portion 21 of the housing 2.

Figure 11A:
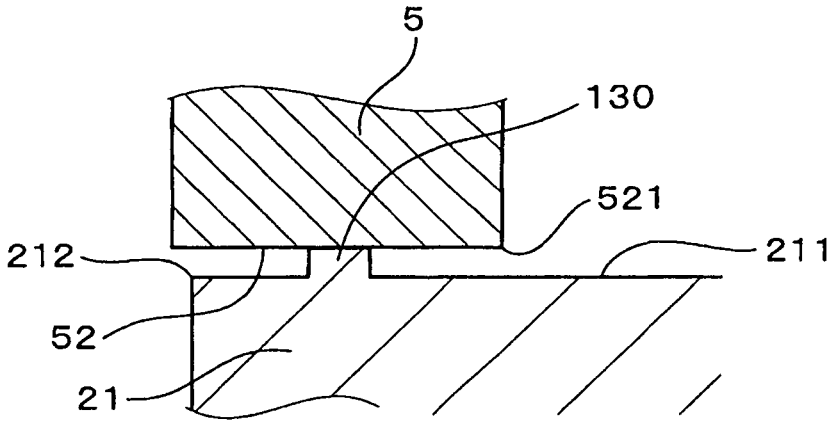
FIG. 11(A) is a partial sectional view which illustrates a ground electrode placed in contact with an annular protrusion of a housing in a joining step in the first embodiment.

Specifically, in the joining step, the annular protrusion 130 is, as illustrated in FIG. 11(A), first placed in contact with the base end surface 52 of the ground electrode 5. The spark gap between the ground electrode 5 and the center electrode 4 is regulated. Specifically, after the assembling steps are performed, but before the ground electrode 5 is resistance-welded to the small-diameter portion 21, the position of the ground electrode 5 relative to the housing 2 is adjusted to set the spark gap between the ground electrode 5 and the center electrode 4. Subsequently, the ground electrode 5 is resistance-welded to the small-diameter portion 21.

More specifically, the ground electrode 5 which is, as can be seen in FIGS. 10(A) and 10(B), of an annular shape is put on the front end surface 211 of the small-diameter portion 21 of the housing 2 so as to have the center electrode 4 placed inside the ground electrode 5. The ground electrode 5 is slid on the front end surface 211 of the housing 2 in the radial direction thereof to regulate the position thereof relative to the center electrode 4 and located in place. Specifically, the spark gap between the outer peripheral surface 41 of the center electrode 4 and the inner peripheral surface 51 of the ground electrode 5 is set to a desired distance. In other words, the ground electrode 5 is moved and located so as to equalize the spark gap between entire circumferences of the outer peripheral surface 41 of the center electrode 4 and the inner peripheral surface 51 of the ground electrode 5.

The ground electrode 5 is located correctly in the above way. The annular protrusion 130 of the housing 2 is, as illustrated in FIG. 11(A), placed in contact with the ground electrode 5 to weld the ground electrode 5 to the housing 2. The welding is made between the base end surface 52 of the ground electrode 5 and the annular protrusion 130 on the front end surface 211 of the housing 2 over the entire circumference of the annular protrusion 130.

When the annular protrusion 130 is placed in contact with the base end surface 52 of the ground electrode 5, the inner circumferential edge of the annular protrusion 130 is, as can be seen in FIG. 11(A), located outside the inner circumferential edge 212 of the front end surface 211 of the small-diameter portion 21, while the outer circumferential edge of the annular protrusion 130 is located inside the outer circumferential edge 521 of the base end surface 52 of the ground electrode 5. The annular protrusion 130 is in contact with the base end surface 52 of the main electrode body 54 of the ground electrode 5.

The current is applied between the housing 2 and the ground electrode 5 with the annular protrusion 130 pressed in contact with the ground electrode 5. This produces heat between the annular protrusion 130 and the base end surface 52 of the ground electrode 5 to resistance-weld the housing 2 and the ground electrode 5 to each other. The mechanical contact between the housing 2 and the ground electrode 5 is achieved only between the annular protrusion 130 and the ground electrode 5. In other words, before welding, the housing 2 and the ground electrode 5 do not contact with each other on an area of the annular boundary 12 other than the annular protrusion 130. In the resistance-welding, the current, thus, flows only through a narrow annular area of contact between the annular protrusion 130 of the housing 2 and the ground electrode 5, thus resulting in an uniform increase in current density on the contact of the annular protrusion 130 and the ground electrode 5, which achieves uniform welding on the whole of the contact.

Figure 11B:
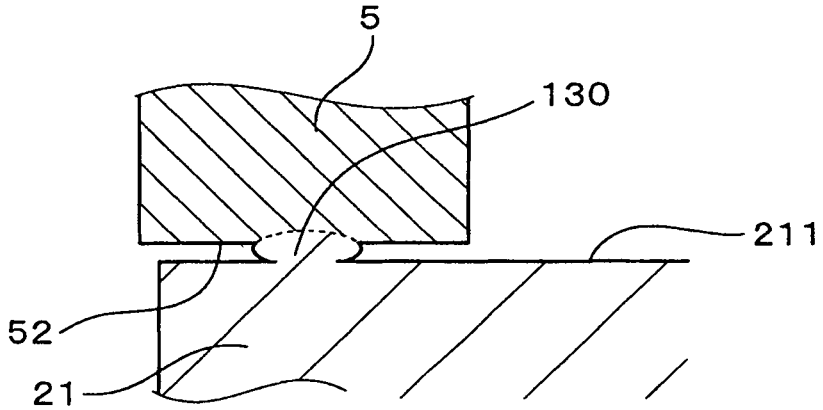
FIG. 11(B) is a partial sectional view which illustrates a ground electrode being welded to a housing during a joining step in the first embodiment.
Figure 11C:
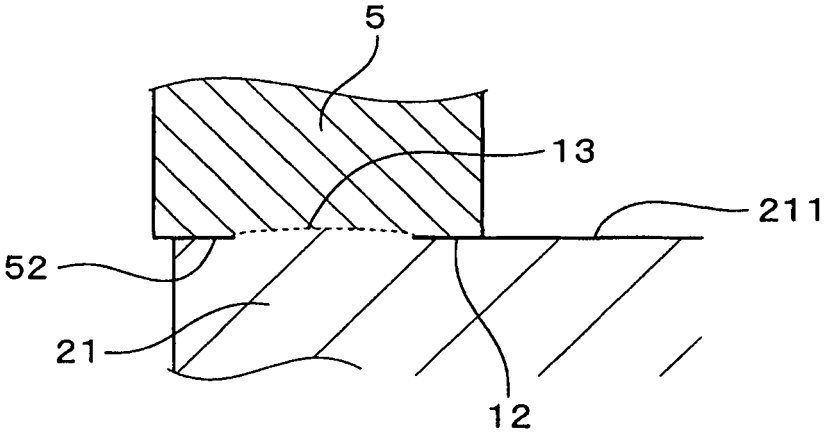
FIG. 11(C) is a partial sectional view which illustrates a ground electrode which has finished welded to a housing during a joining step in the first embodiment.
Figure 12A:
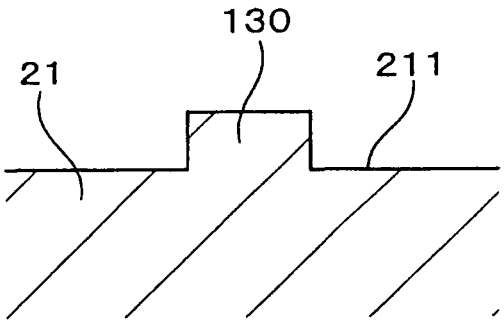
FIG. 12(A) is a sectional view which illustrates a first modification of an annular protrusion on a housing of a spark plug in the first embodiment.
Figure 12B:
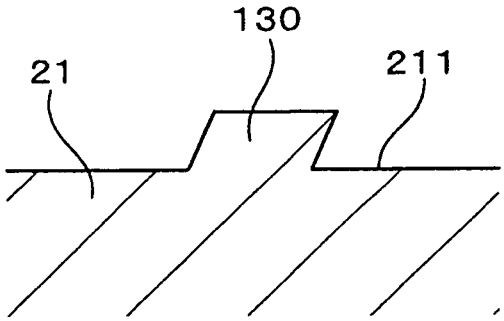
FIG. 12(B) is a sectional view which illustrates a second modification of an annular protrusion on a housing of a spark plug in the first embodiment.
Figure 12C:
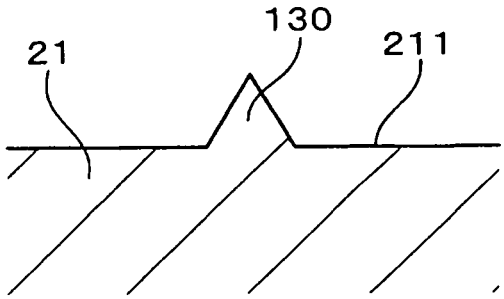
FIG. 12(C) is a sectional view which illustrates a third modification of an annular protrusion on a housing of a spark plug in the first embodiment.
Figure 12D:
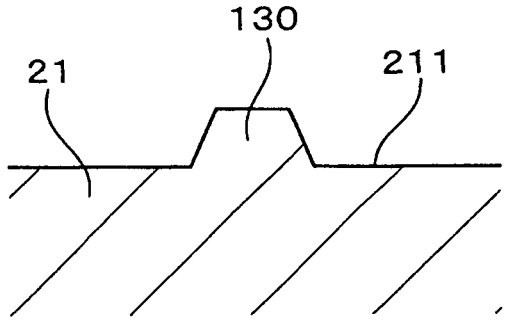
FIG. 12(D) is a sectional view which illustrates a fourth modification of an annular protrusion on a housing of a spark plug in the first embodiment.

The annular protrusion 130 is, as demonstrated in FIGS. 11(A), 11(B), and 11(C), gradually melted and mixed with the base end surface 52 of the ground electrode 5 to complete the weld of the annular protrusion 130 and the ground electrode 5. In the case where the housing 2 is, as described above, made of Fe-based alloy, and the ground electrode 5 is made of Ni-based alloy, the ground electrode 5 mainly is melted by the resistance heat because the Ni-based alloy is low in melting point. This causes the annular protrusion 130 of the housing 2 to bite into and then be welded to the base end surface 52 of the ground electrode 5 to make the annular weld 13.

When the front end surface 211 of the small-diameter portion 21 of the housing 2 and the base end surface 52 of the ground electrode 5 fully contact each other, an area of the contact will be, as illustrated in FIG. 11(C), maximized, so that the current density will be small, thus completing the resistance welding.

The annular protrusion 130, as demonstrated in FIGS. 5 and 6, becomes the annular weld 13 which joints the housing 2 and the ground electrode 5 to each other and continuously and fully extends in a circumferential direction of the housing 2 (i.e., the ground electrode 5). Note that FIG. 5 emphasizes the configuration of the annular weld 13 embedded in the ground electrode 5 for the ease of visibility thereof. Actually, after the housing 2 and the ground electrode 5 are welded together, the annular weld 13 will be substantially in the form illustrated in FIG. 11(C).

The annular protrusion 130 has the width W1 in the plug radial direction which is selected to ensure the stability of the resistance welding and, for example, 0.1 mm to 1.0 mm. The height of the annular protrusion 130 in the plug axial direction is also selected to ensure the stability of the resistance welding and is, for example, 0.2 mm to 0.8 mm. In such a case, the annular weld 13 has a width of 0.1 mm to 1.0 mm in the plus radial direction and a height of 0.2 mm to 0.8 mm in the plug axial direction in this embodiment.

FIG. 11(A) demonstrates the annular protrusion 130 which has a rectangular section, as taken perpendicular to the plug circumferential direction, but however, it may be designed to have another shape. For instance, the annular protrusion 130 may be formed to have a shape illustrated in any of FIGS. 12(A) to 12(D). Specifically, the annular protrusion 130 may have a parallelogram transverse section of FIG. 12(B), a triangular transverse section of FIG. 12(C), or a trapezoidal transverse section of FIG. 12(D). The annular protrusion 130 may have any shape as long as it occupies an annular portion of a width of the front end surface 211 of the small-diameter portion 21 of the housing 2 at the annular boundary 12 in order to equalize the distribution of welding current to the annular protrusion 130 at the initial stage of the welding.

Figure 13A:
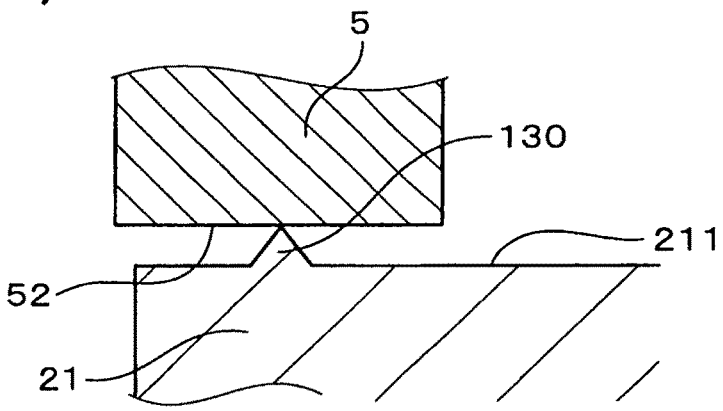
FIG. 13(A) is an explanatory view which demonstrates initial stage of a joining step of a production method to place a ground electrode on a triangular protrusion formed on a housing in a spark plug of the first embodiment.
Figure 13B:
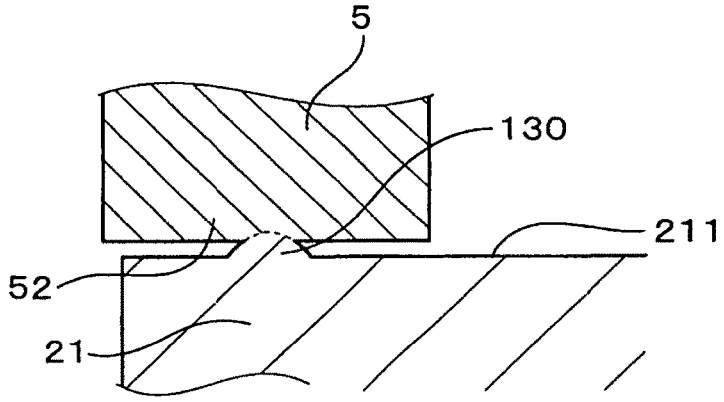
FIG. 13(B) is an explanatory view which demonstrates an intermediate stage of a joining step of a production method to weld a ground electrode to a housing through a triangular annular protrusion in the spark plug of the first embodiment.
Figure 13C:
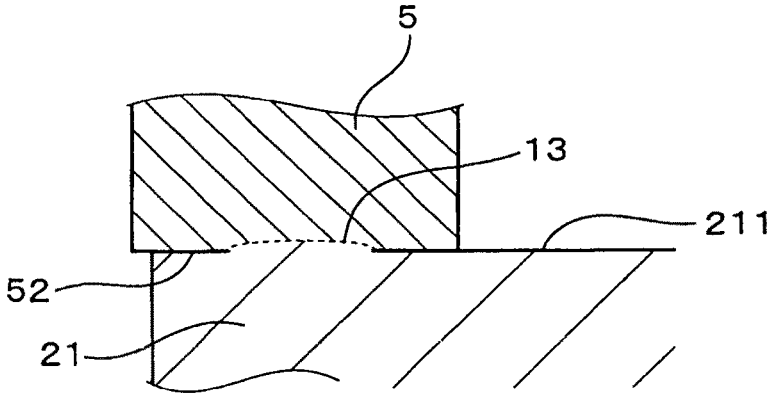
FIG. 13(C) is an explanatory view which demonstrates a final stage of a joining step of a production method to finish welding a ground electrode to a housing through a triangular annular protrusion in the spark plug of the first embodiment.

In the case where the annular protrusion 130 has the triangular transverse section, as illustrated in FIGS. 13(A) to 13(C), the current density will be high at the initial stage of the resistance welding and then decrease with the melting of the annular protrusion 130. This enhances the stability in forming the annular weld 13 continuously in the circumferential direction of the ground electrode 5 and the housing 2. The same is true of the trapezoidal transverse section of FIG. 12(D).

In the case where the housing 2 is made of Fe-based alloy, and the ground electrode 5 (i.e., the main electrode body 54) is made of Ni-based alloy, the annular weld 13 will be produced by the annular protrusion 130 biting into the base end surface 52 of the ground electrode 5, thereby increasing the mechanical strength of the annular weld 13.

The spark plug 1 of this embodiment is, as apparent from the above discussion, designed to have the annular weld 13 which occupies an annular portion of a width of the front end surface 211 of the small-diameter portion 21 of the housing 2 on the annular boundary 12 and fully and continuously extends in the circumferential direction of the front end surface 211. In other words, the annular protrusion 130 which has the small width W1 is formed continuously on the front end surface 211 of the small-diameter portion 21 of the housing 2 and fully extends in the circumferential direction of the housing 2, thereby ensuring the stability in welding the ground electrode 5 to the small-diameter portion 21.

Specifically, the joining step to resistance-weld the ground electrode 5 to the small-diameter portion 21 of the housing 2 is achievable only by placing the annular protrusion 130 in contact with the base end surface 52 of the ground electrode 5. The resistance-welding is, therefore, made only at a circumferentially extending portion of the width of the annular boundary 12, not the whole of the annular boundary 12 where the small-diameter portion 21 and the ground electrode 5 face each other, thereby facilitating ease with which the entire circumference of the ground electrode 5 is continuously welded to the small-diameter portion 21 to ensure the stability in joining the ground electrode 5 to the small-diameter portion 21, that is, in positioning the center electrode 4 and the ground electrode 5 relative to each other to obtain a desired size of the spark gap.

If the small-diameter portion 21 of the housing 2 and the ground electrode 5 are placed in contact with each other on the whole of the annular boundary 12 and fully welded together, there is a concern about the instability in the resistance-welding. Specifically, when the housing 2 and the ground electrode 5 are resistance-welded on the whole of the annular boundary 12, it may result in a variation in ease of flow of electrical current over the annular boundary 12 due to a variation in degree to which the housing 2 and the ground electrode 5 are melted on the annular boundary 12, which leads in the worst case to a partial failure of the welding on the annular boundary 12

Additionally, if a large current locally flows to weld the housing 2 and the ground electrode 5 on the annular boundary 12, it may cause a portion of the small-diameter portion 21 through which the large current flows to buckle, which results in decreased accuracy of adjustment of the spark gap between the ground electrode 5 and the center electrode 4.

The spark plug 1 of this embodiment is, however, designed to have the narrow annular protrusion 130 which is formed on the front end surface 211 of the housing 2 and placed in contact with the ground electrode 5 when the ground electrode 5 is welded to the housing 2. This facilitates ease of making a physical contact of the entire circumference of the ground electrode 5 with the housing 2, thereby ensuring the stability in flow of the current through such a contact during the resistance-welding to make the annular weld 13 which continuously and fully extends in the circumferential direction of the ground electrode 5.

This embodiment, as apparent from the above discussion, provides the spark plug 1 for internal combustion engines which has an increased service life, required ability to ignite fuel in internal combustion engines, and an improved structure in which it is easy to adjust the spark gap between the ground electrode 5 and the center electrode 4 and a production method of the spark plug 1.

Second Embodiment

Figure 14A:
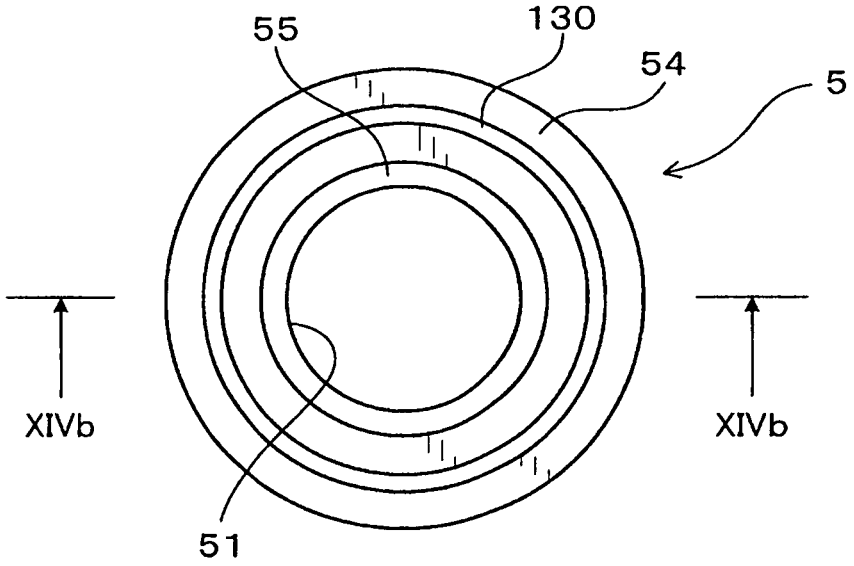
FIG. 14(A) is a plane view of a ground electrode of a spark plug in the second embodiment.
Figure 14B:
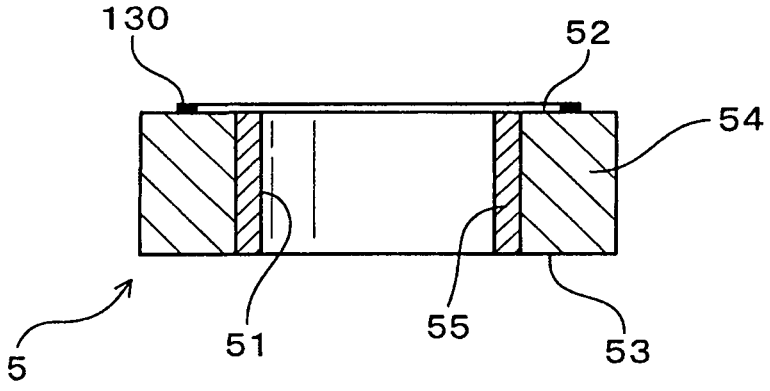
FIG. 14(B) is a sectional view, as taken along the line XIVb-XIVb of FIG. 14(A)

FIGS. 14(A) and 14(B) illustrate the second embodiment in which the annular protrusion 130 is formed on the base end surface 52 of the ground electrode 5.

In the joining step, the annular protrusion 130 of the ground electrode 5 is placed in contact with the front end surface 211 of the small-diameter portion 21 of the housing 2. The ground electrode 5 is then resistance-welded to the small-diameter portion 21.

Although not illustrated, the small-diameter portion 21 of the housing 2 has no annular protrusion. The front end surface 211 of the housing 2 is even or flat.

In the joining step to resistance-weld the ground electrode 5 to the housing 2, the current flow concentrates on the contact between the annular protrusion 130 of the ground electrode 5 and the front end surface 211 of the housing 2, thereby causing the annular protrusion 130 of the ground electrode 5 which is made of Ni-based alloy mainly to be melted and joined to the front end surface 211 of the housing 2 which is made of Fe-based alloy. This forms the annular weld 13 on a portion of the annular boundary 12 through which the front end surface 211 of the small-diameter portion 21 of the housing 2 faces the ground electrode 5.

Other arrangements are identical with those in the first embodiment. The structure of the spark plug 1 of this embodiment provides substantially the same beneficial advantages as in the first embodiment.

In the second and following embodiments, the same reference numbers as those in the first embodiment will refer to the same parts unless otherwise specified, and explanation thereof in detail is omitted.

Third Embodiment

Figure 15:
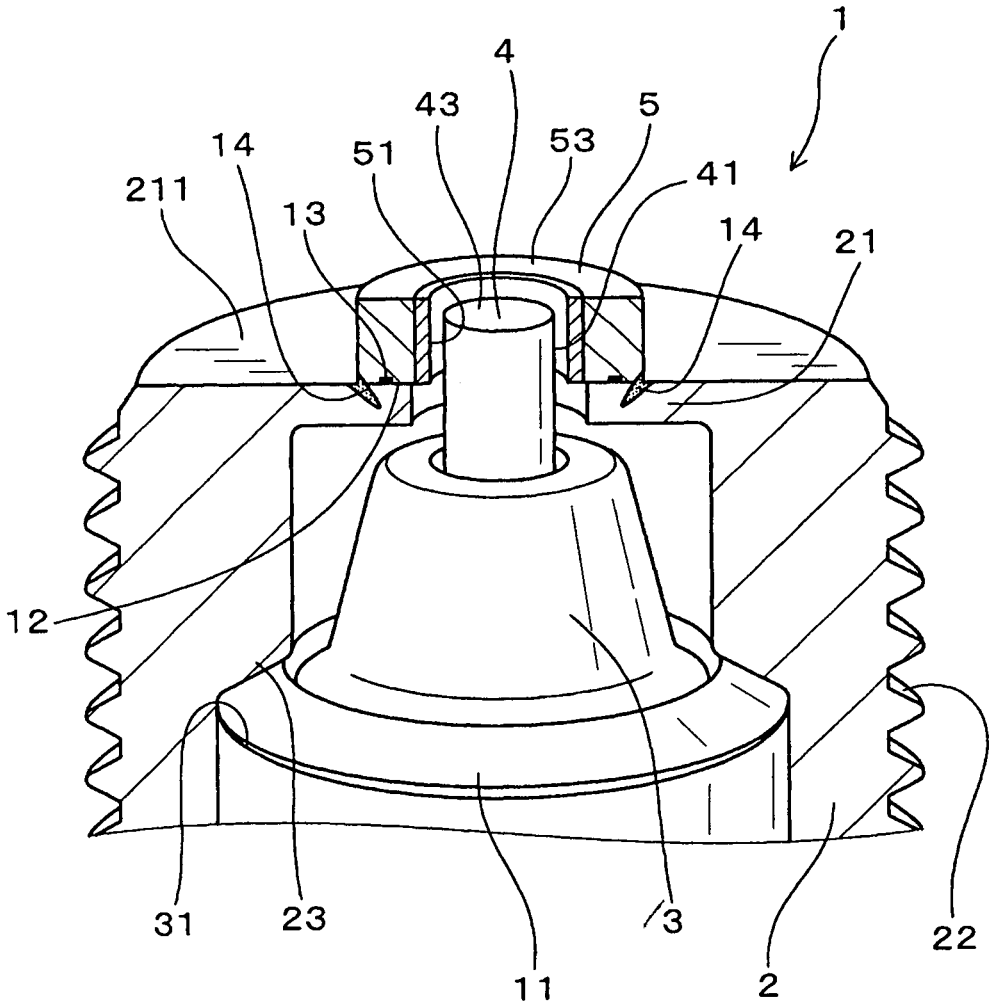
FIG. 15 is a partially perspective sectional view which illustrates a region around a front end portion of a spark plug according to the third embodiment.

FIG. 15 shows the spark plug 1 of the third embodiment which has the material-mixed portion 14 (also called a weld nugget) that is a mixture of molten materials of the ground electrode 5 and the housing 2 and extends from an outer peripheral edge of the ground electrode 5 into the small-diameter portion 21 of the housing 2 through the annular boundary 12. The annular weld 13 is formed inside the material-mixed portion 14.

Specifically, in the spark plug 1 of this embodiment, the ground electrode 5 is joined to the front end surface 211 of the housing 2 using resistance welding and laser welding. More specifically, the annular weld 13 is formed by the resistance welding, while the material-mixed portion 14 is formed by the laser welding. The ground electrode 5 is joined to the housing 2 through the annular weld 13 and the material-mixed portion 14.

The joining step in the production method of the spark plug 1 includes a resistance welding step to perform the resistance welding in the same way as described above and a laser welding step to laser-weld the ground electrode 5 to the small-diameter portion 21 of the housing 2. The laser welding step is made following the resistance welding step in which the spark gap is adjusted. The laser welding is made by irradiating a laser beam to the annular boundary 12 (i.e., an interface between the ground electrode 5 and the small-diameter portion 21) from outside the outer periphery of the ground electrode 5.

The laser welding may be done continuously around the complete circumference of the ground electrode 5 by using, for example, a CW (continuous wave) laser welding technique. The laser welding may alternatively be made on a portion(s) of the circumference of the ground electrode 5. For example, laser pulses may be emitted to a plurality of points on the circumference of the ground electrode 5 to make a plurality of material-mixed portions 14.

By the laser welding as described above, the material-mixed portion 14 is formed which extends from the outer peripheral edge of the ground electrode 5 facing the small-diameter portion 21 into the small-diameter portion 21. The material-mixed portion 14 is, as described above, made by a mixture of material (i.e., Ni-based alloy) of the ground electrode 5 and material (i.e., Fe-based alloy) of the housing 2, that is, formed in a way in which the Ni-based alloy of the ground electrode 5 and the Fe-based alloy of the housing 2 are melted and then solidified The material-mixed portion 14 is located outside the annular weld 13 in the radial direction of the housing 2. In the laser welding step, a laser beam is emitted so as not to melt the annular weld 13 made in the resistance welding step. This eliminates a risk that the ground electrode 5 which is accurately positioned on the housing 2 in the resistance welding step is undesirably moved relative to the housing 2 in the laser welding step. The strength of the resistance welding may be selected only to make a temporary joint(s) of the ground electrode 5 to the housing 2. The temporary joint may be formed by using a low electrical current to achieve a decreased amount of molten material of the annular protrusion 130. This enhances the accuracy in adjusting the spark gap between the ground electrode 5 and the center electrode 4 and also reduces a variation in the spark gap.

This embodiment is, as apparent from the above discussion, capable of positioning the ground electrode 5 to a desired location on the housing 2 and ensures the stability in joining the ground electrode 5 to the housing 2 through the annular weld 13 and the material-mixed portion 14.

Other arrangements are identical with those in the first embodiment. The structure of the spark plug 1 of this embodiment provides substantially the same beneficial advantages as in the first embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

The housing 2 is, as described above, made of Fe-based alloy, while the ground electrode 5 is made of Ni-based alloy, however, they may be made of another kind of material.

In the above embodiments, the annular weld 13 is embedded from the front end surface 211 of the small-diameter portion 21 into the ground electrode 5, but however, may be shaped to be embedded from the base end surface 52 of the ground electrode 5 into the small-diameter portion 21. In other words, the annular protrusion 130 of the ground electrode 5 may be shaped so as to bite into the small-diameter portion 21 of the housing 2 depending upon the kind of material of the housing 2 and/or the ground electrode 5.

What is claimed is:

1. A spark plug for an internal combustion engine comprising:

a cylindrical housing;

a cylindrical porcelain insulator which is retained inside the housing;

a center electrode which is retained inside the porcelain insulator and has a head extending outside a front end of the porcelain insulator; and an annular ground electrode which is secured to a front end of the housing, wherein the housing has a small-diameter portion formed on the front end thereof, the small-diameter portion having an inner diameter which is smaller than that of a rest of the housing, wherein the ground electrode protrudes from a front end surface of the small-diameter portion and has an inner peripheral surface facing an outer peripheral surface of the center electrode, wherein the ground electrode has an outer diameter which is smaller than an outer diameter of the front end surface of the small-diameter portion, and wherein an annular boundary through which the front end surface of the small-diameter portion and a base end surface of the ground electrode face each other has an annular region which occupies a portion of a width thereof and fully extends in a circumferential direction thereof and in which an annular weld is formed which establishes a joint between the housing and the ground electrode, the annular weld continuously extending in a circumferential direction of the annular region.

2. A spark plug as set forth in claim 1, wherein the annular weld has an inner circumferential edge located outside an inner circumferential edge of the front end surface of the small-diameter portion, the annular weld also having an outer circumferential edge located inside of the base end surface of the ground electrode.

3. A spark plug as set forth in claim 1, wherein the annular weld is shaped to be embedded from the front end surface of the small-diameter portion into the ground electrode or from the base end surface of the ground electrode into the small-diameter portion.

4. A spark plug as set forth in claim 3, wherein the annular weld is shaped so as to bite from the front end surface of the small-diameter portion into the ground electrode.

5. A spark plug as set forth in claim 1, further comprising a material-mixed portion that is a mixture of molten materials of the ground electrode and the housing and extends from an outer peripheral edge of the ground electrode into the small-diameter portion of the housing through the annular boundary, the annular weld being formed inside the material-mixed portion.

* * * * *